US012618631B2

(12) United States Patent
Shaw et al.

(10) Patent No.: US 12,618,631 B2
(45) Date of Patent: May 5, 2026

(54) SUPPRESSOR

(71) Applicant: Shaw Armament Systems, LLC, Powder Springs, GA (US)

(72) Inventors: Bryan David Shaw, Powder Springs, GA (US); Joseph Curtis Jones, Dallas, GA (US)

(73) Assignee: Shaw Armament Systems, LLC, Powder Springs, GA (US)

( * ) Notice: Subject to any disclaimer, the term of this patent is extended or adjusted under 35 U.S.C. 154(b) by 0 days.

(21) Appl. No.: 18/658,608

(22) Filed: May 8, 2024

(65) Prior Publication Data

US 2024/0377152 A1 Nov. 14, 2024

Related U.S. Application Data

(60) Provisional application No. 63/623,134, filed on Jan. 19, 2024, provisional application No. 63/465,155, filed on May 9, 2023.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS 3,713,362 A * 1/1973 Charron ..... F41A 21/30 89/14.4
5,164,535 A * 11/1992 Leasure ..... F41A 21/30 89/14.4
6,575,074 B1 * 6/2003 Gaddini ..... F41A 21/30 89/14.4
8,453,789 B1 * 6/2013 Honigmann ..... F41A 21/325 89/14.4
8,459,405 B1 * 6/2013 Dueck ..... F41A 21/34 89/14.4
8,561,757 B1 * 10/2013 Edsall ..... F41A 21/30 89/14.4
8,579,075 B2 * 11/2013 Brittingham ..... F41A 21/30 89/14.4
8,844,422 B1 * 9/2014 Klett ..... F41A 21/34 89/14.4
8,939,057 B1 * 1/2015 Edsall ..... F41A 21/30 89/14.05
8,973,481 B2 * 3/2015 Dueck ..... F41A 21/30 89/14.4
9,140,511 B2 * 9/2015 Michal ..... F41A 21/30
(Continued)

*Primary Examiner* — Michelle Clement
(74) *Attorney, Agent, or Firm* — Buchalter LLP

(57) ABSTRACT

A suppressor assembly is disclosed. The suppressor can comprise an outer tube defining a barrel axis, a first endcap configured to couple to a barrel of a firearm at a first end of the outer tube, and a spacer assembly in the outer tube. The spacer assembly can be positioned and/or captured between the first endcap and an exit side of the outer tube. The spacer assembly can comprise a plurality of spacers comprising a plurality of small and large diameter baffles oriented in different desirable positions within the spacer assembly. The baffles and spacers can be constructed from different materials so the weight of the baffles are greater than the weight of the spacers.

18 Claims, 8 Drawing Sheets

(56) References Cited

U.S. PATENT DOCUMENTS 9,239,201 B1 * 1/2016 Reis Green ..... F41A 21/30
9,470,466 B2 * 10/2016 Washburn, III ..... F41A 21/30
9,500,427 B1 * 11/2016 Larue ..... F41A 21/30
9,658,010 B1 * 5/2017 Oglesby ..... F41C 23/16
9,658,019 B2 * 5/2017 Smith ..... F41A 21/30
9,777,979 B2 * 10/2017 Washburn, III ..... F41A 21/30
9,982,959 B2 * 5/2018 Washburn, III ..... F41A 21/30
10,107,581 B2 * 10/2018 Garst ..... F41A 21/30
10,119,779 B1 * 11/2018 Miele ..... F41A 21/30
10,126,084 B1 * 11/2018 Oglesby ..... F41A 21/30
10,330,418 B2 * 6/2019 Washburn, III ..... F41A 21/30
10,371,476 B1 * 8/2019 Oglesby ..... F41A 21/30
10,458,737 B2 * 10/2019 Schwartzkopf ..... B22F 5/00
10,634,445 B1 * 4/2020 Klett ..... F41A 21/30
10,690,431 B2 * 6/2020 Washburn, III ..... F41A 21/30
10,746,491 B2 * 8/2020 Garst ..... F41A 21/30
10,907,920 B2 * 2/2021 Walker ..... F41A 21/30
11,092,399 B2 * 8/2021 Washburn, III ..... F41A 21/30
11,105,577 B1 * 8/2021 Thomas ..... F41A 3/40
11,125,524 B2 * 9/2021 Miele ..... F41A 21/30
11,255,623 B2 * 2/2022 Kras ..... F41A 21/30
11,280,571 B2 * 3/2022 Miller ..... F41A 21/34
11,428,491 B2 * 8/2022 Nagy-Zambo ..... F41A 21/30
11,435,155 B2 * 9/2022 Washburn, III ..... F41A 21/30
11,435,156 B1 * 9/2022 Dellinger ..... G10K 11/165
11,466,952 B2 * 10/2022 Tiziani ..... F41A 21/30
11,486,669 B2 * 11/2022 Bowers ..... F41A 21/30
11,493,298 B2 * 11/2022 Magee ..... F41A 21/30
11,662,172 B2 * 5/2023 Langenbeck ..... F41A 21/30
89/14.4
11,668,540 B2 * 6/2023 Spector ..... F41A 21/34
89/14.4
11,686,547 B2 * 6/2023 Kras ..... F41A 21/30
89/14.4
11,835,314 B2 * 12/2023 Walker ..... F41A 21/30
11,892,259 B2 * 2/2024 Grob ..... F41A 21/30
11,994,354 B2 * 5/2024 Edminster ..... F41A 21/30
12,025,390 B2 * 7/2024 DeJessa ..... F41A 21/30
12,130,106 B2 * 10/2024 Madigan ..... F41A 21/30
12,173,975 B2 * 12/2024 Magee ..... F41A 21/30
12,313,359 B2 * 5/2025 DeJessa ..... F41A 21/30
12,345,492 B2 * 7/2025 Piche ..... F41A 21/30
12,410,983 B2 * 9/2025 Graham, II ..... F41A 21/30
2013/0180797 A1 * 7/2013 Dueck ..... F41A 21/325
181/296
2013/0319790 A1 * 12/2013 Bladen ..... F41A 21/30
181/223
2014/0224574 A1 * 8/2014 Latka ..... F41A 21/30
181/223
2014/0231168 A1 * 8/2014 Dueck ..... F41A 21/325
181/223
2014/0262605 A1 * 9/2014 Washburn, III ..... F41A 21/30
264/294
2014/0299405 A1 * 10/2014 Miller ..... F41A 21/30
181/223
2015/0001001 A1 * 1/2015 Wilson ..... F41A 21/36
219/76.1
2015/0241159 A1 * 8/2015 Michal ..... F41A 21/44
89/14.4
2015/0260472 A1 * 9/2015 Smith ..... F41A 21/30
89/14.2
2015/0285575 A1 * 10/2015 Sclafani ..... F41A 21/30
29/402.08
2015/0308776 A1 * 10/2015 Smith ..... F41A 21/34
89/14.2
2015/0354422 A1 * 12/2015 Liskey ..... F41A 21/30
89/14.4
2016/0018177 A1 * 1/2016 Powell ..... F41A 21/30
89/14.4
2016/0061551 A1 * 3/2016 Petersen ..... F41A 21/30
89/14.4
2016/0187093 A1 * 6/2016 Barrett ..... F41A 21/30
89/14.4
2016/0209151 A1 * 7/2016 Smith ..... F41A 21/30
2017/0205175 A1 * 7/2017 Garst ..... F41A 21/30
2017/0299291 A1 * 10/2017 Spector ..... F41A 5/26
2017/0299313 A1 * 10/2017 Adamson, Jr. ..... F41A 21/30
2018/0031346 A1 * 2/2018 Washburn, III ..... F41A 21/30
2018/0038663 A1 * 2/2018 Larue ..... F41A 21/30
2018/0120044 A1 * 5/2018 Lagenbeck ..... F41A 21/24
2018/0202744 A1 * 7/2018 De Sousa ..... F41A 21/30
2018/0313625 A1 * 11/2018 Tomczak ..... B23K 33/006
2018/0340749 A1 * 11/2018 Palu ..... F41A 21/30
2018/0372438 A1 * 12/2018 Washburn, III ..... F41A 21/30
2019/0063860 A1 * 2/2019 Walker ..... F41A 21/30
2019/0186860 A1 * 6/2019 Ellison ..... F41A 21/30
2019/0277591 A1 * 9/2019 Schwartzkopf ..... F41A 21/30
2020/0025491 A1 * 1/2020 Petersen ..... B33Y 80/00
2020/0072571 A1 * 3/2020 Washburn, III ..... B22F 7/004
2020/0141679 A1 * 5/2020 Garst ..... F41A 21/30
2020/0173751 A1 * 6/2020 Dorne ..... F41A 21/30
2020/0200499 A1 * 6/2020 Lindström ..... F41A 1/08
2021/0116200 A1 * 4/2021 Graham ..... F41A 21/30
2021/0116201 A1 * 4/2021 Walker ..... F41A 21/30
2021/0207916 A1 * 7/2021 Belykov ..... F41A 21/30
2021/0333061 A1 * 10/2021 Muceus ..... F41A 21/30
2022/0057160 A1 * 2/2022 Johns ..... F41A 21/30
2022/0276016 A1 * 9/2022 Dueck ..... F41A 21/34
2022/0349667 A1 * 11/2022 Dellinger ..... G10K 11/165
2023/0021170 A1 * 1/2023 Dueck ..... G06F 30/28
2023/0194201 A1 * 6/2023 Muceus ..... F41A 21/44
89/14.05
2023/0288163 A1 * 9/2023 Hibbitts ..... F41A 21/44
2023/0296344 A1 * 9/2023 Graham, II ..... F41A 21/325
89/14.4
2024/0159488 A1 * 5/2024 Sims ..... F41A 21/30
2025/0093120 A1 * 3/2025 Grob ..... F41A 21/325
2025/0244095 A1 * 7/2025 Naumu ..... F41A 21/30

* cited by examiner

SUPPRESSOR

REFERENCE TO RELATED APPLICATIONS

This application claims the benefit of U.S. Provisional Application No. 63/623,134, filed Jan. 19, 2024, and U.S. Provisional Application No. 63/465,155, filed May 9, 2023, each of which is hereby specifically incorporated by reference herein in its entirety.

TECHNICAL FIELD

This disclosure relates to an adjustable and lightweight device attachment. More specifically, this disclosure relates to a device for suppressing gas expansion and reducing noise by attaching the device to a firearm's barrel.

BACKGROUND

When a bullet is ejected from the barrel of a firearm, explosive energy may also be ejected in the form of noise, gas, and other debris. This can lead to noise generation, muzzle flash, and/or gas and debris exiting from the firearm barrel. This can be undesirable and may even change the trajectory of the bullet.

Suppressors separate the gas and debris and reduce the noise and/or muzzle flash produced when the firearm is operated. Different sizes and shapes of suppressors are needed for different calibers and sizes of firearms (e.g., a pistol or a rifle of the same caliber may have different-sized suppressors). A suppressor can add significant weight to a firearm and the required materials/components of the suppressor can make the weight of the firearm a significant factor in the operation of the firearm.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a spacer assembly comprising a spacer and a baffle. The spacer comprises an elongated section comprising a lip, a gripping section coupled to the elongated section, and an attachment section. The baffle comprises a base oriented within the lip, wherein the lip restrains the baffle in an axial direction, and the base is free to rotate within the lip.

In a further aspect, disclosed is a suppressor comprising an outer tube defining a barrel axis. A first endcap is configured to couple to a barrel of a firearm at a first end of the outer tube. A second endcap is coupled to the outer tube on a side opposite the first endcap. A plurality of baffles are captured by spacers interposed between and coupled to the first endcap and the second endcap. Each baffle comprises an elongated slot, wherein: the baffles are spaced evenly along the barrel axis by the spacers, and the elongated slots are oriented at different angles relative to the barrel axis.

Various implementations described in the present disclosure may comprise additional systems, methods, features, and advantages, which may not necessarily be expressly disclosed herein but will be apparent to one of ordinary skill in the art upon examination of the following detailed description accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and, together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

In one aspect, a suppressor and associated methods, systems, devices, and various apparatuses are disclosed herein. In some aspects, the suppressor can comprise a variable length and weight so that the suppressor can be customized. In some aspects, the suppressor comprises a baffle and spacer utilizing diverse high-strength and low-weight materials to reduce the total weight of the suppressor. In some aspects, a through-hole or borehole can comprise an elongated slot, such that the transverse width of the borehole is less than the longitudinal width of the borehole. In various aspects, the relative orientation of the through-hole and/or a series of large through-holes followed by small through-holes, alternating large and small through holes and/or small through-holes followed by large through holes can enhance the suppressor properties, e.g., to reduce the sound and/or debris (muzzle flash) escaping from the suppressor and/or reduce the weight and improve the customization of the suppressor.

Figure 1:
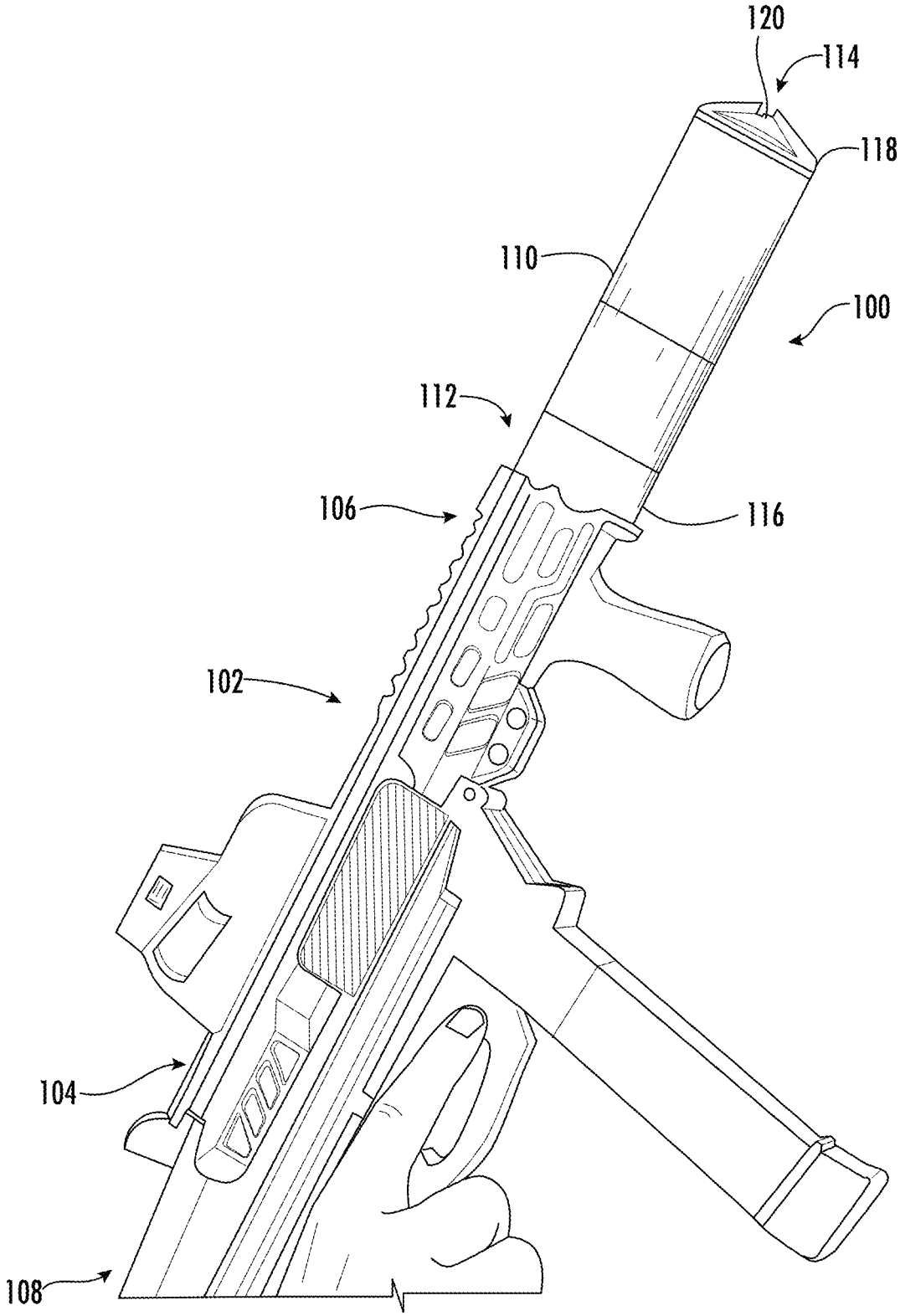
FIG. 1 is a perspective view of a suppressor coupled to a firearm, in accordance with one aspect of the current disclosure.

One aspect of a suppressor 100 is disclosed and described in FIG. 1. A suppressor 100, also known as a silencer, can reduce the noise and/or the muzzle flash a firearm 102 produces, e.g., when the firearm 102 is discharged. The firearm 102 can comprise an action 104, a barrel 106, and a stock 108. The action 104 loads, fires, and/or ejects the projectile and/or casing. The barrel 106 is typically a metal tube that supports and directs the projectile. The inner surfaces of the barrel 106 can be rifled to generate a spin on the projectile and/or improve the barrel's accuracy in determining the projectile's path. The stock 108 is usually held by the operator of the firearm 102 and can couple the action 104 of the firearm 102 to the barrel 106.

When firearm 102 is operated to eject a projectile (e.g., bullet), the projectile first travels down barrel 106 of the firearm 102 and exits into suppressor 100. This process can generate high-pressure gasses that can create loud noises and/or a bright flash, called a muzzle flash. When the gas and projectile enter suppressor 100, the gas can be separated and/or captured. The natural frequency response of the firearm 102 can be modified by the suppressor 100 to reduce the noise, and debris (e.g., non-combusted residue, dirt, etc.) can similarly be slowed down and redirected with the flow of the high-pressure gas outside the pathway of the projectile. When the high-pressure gas and debris are separated, they can expand and cool. As described below, this process is repeated as the projectile passes through each subsequent baffle, causing the gas to expand and cool further, reducing the noise and/or flash produced by the firearm 102 and ejected from the suppressor 100.

The suppressor 100 couples to barrel 106 of the firearm 102 to capture the gasses and debris escaping from barrel 106 during the ejection of a projectile, to reduce the noise and/or muzzle flash produced when the projectile is fired and ejects from firearm 102.

Suppressor 100 comprises an outer tube, referred to as tube 110, coupled to a mounting system 112 and an exit portal 114. Tube 110 partially or completely surrounds the components of the suppressor 100 and protects the internal components from the exterior environment. Tube 110 protects the internal components from inadvertent damage, corrosion, and/or jarring, resulting in the misalignment of the suppressor 100 and/or the various components within tube 110.

The mounting system 112 comprises a first or barrel-side endcap 116, and the exit portal 114 comprises a second or exit-side endcap 118 of the suppressor 100. In various embodiments, the endcaps comprise a borehole 120 aligned with the bore in barrel 106 of firearm 102. As used herein, firearm 102 can be a rifle or a pistol. Specifically, the suppressor 100 can be configured to attach to the barrel 106 of a handheld firearm, such as a pistol or revolver, or a rifle, such as a bolt action rifle or shotgun. In addition, the suppressor 100 can be used on automatic, semi-automatic, and/or single-round firearms 102.

Figure 2:
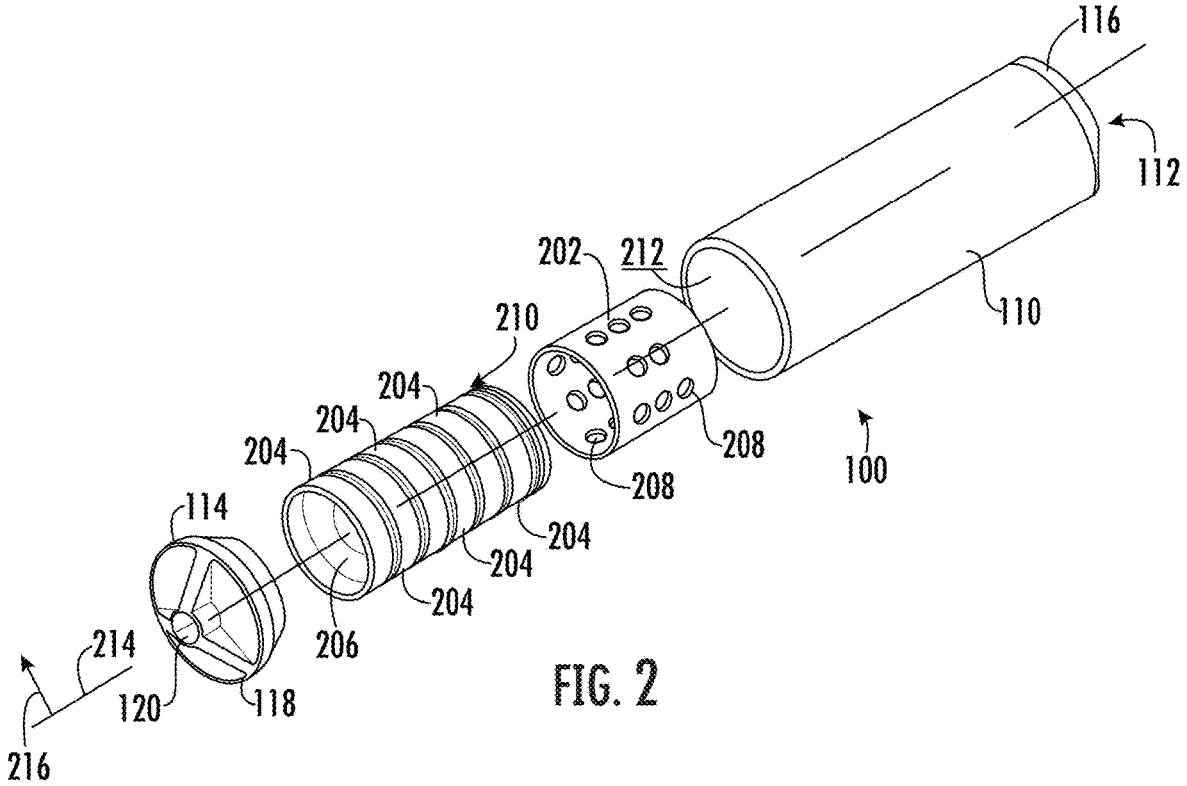
FIG. 2 is an exploded perspective view of the suppressor of FIG. 1.

As illustrated in FIG. 2, within tube 110 of the suppressor 100, a blast baffle 202, is coupled to the barrel-side endcap 116 and the exit-side endcap 118 opposite the mounting system 112 that couples the suppressor 100 to the barrel of the firearm. Moving from the barrel-side endcap 116 towards the exit-side endcap 118, the components housed within the tube 110 of the suppressor 100 are the blast baffle 202, a plurality of spacers 204, each supporting a baffle 206, and the exit-side endcap 118. As explained below, the spacer 204 can be an assembly comprising a spacer 204 and a baffle 202.

The suppressor 100 comprises two endcaps (e.g., the barrel-side endcap 116 and the exit-side endcap 118). The barrel-side endcap 116 comprises the mounting system 112 that couples the suppressor 100 to the barrel 106 of the firearm 102. More specifically, one endcap (116 and/or 118) can be located at each end of the tube and/or can seal the suppressor 100 and keep the internal components (e.g., spacers 204 and/or baffles 202) in place.

The mounting system 112 can facilitate attachment of the suppressor 100 to the firearm 102. Various mounting systems 112 include threaded mounts and/or quick-detach mounts. The mounting system 112 can permit the operator to easily attach and/or remove the suppressor 100 from the firearm 102. The mounting system 112 can comprise a mount, e.g., coupled to the barrel-side endcap 116. The mounting system can be interposed between and coupled to the barrel 106 and the silencer (e.g., suppressor 100). In various aspects, the mount can be a direct thread mount, a quick-detach mount, a fixed barrel mount, and/or a muzzle break mount. As illustrated, the barrel-side endcap 116 can be threadedly engaged with the tube 110 and blast baffle 202, such that the mounting system 112 directly engages with the tube 110 and blast baffle 202 of the suppressor 100.

In some aspects, the blast baffle 202 can be the first separating baffle or filtering structure that the projectile, hot gases, and/or debris encounter in the suppressor 100. The blast baffle 202 can be located in the suppressor 100 near barrel 106, e.g., at the barrel-side endcap 116 of the suppressor 100. The blast baffle 202 can be configured to withstand the initial force and high-temperature blast of the escaping gas and debris. The blast baffle 202 can redirect the blasted gas and debris out of the pathway of the projectile passing through the other baffles 206 positioned further away from the barrel-side endcap 116 of the suppressor 100.

Both sides of the blast baffle 202 can comprise (two) sets of internal threads and define the first baffle 206 that the projectile and/or gases traverse. The blast baffle 202 can withstand, redirect, and/or suppress the initial burst of gas, muzzle flash, and/or noise escaping from barrel 106 of firearm 102. The blast baffle 202 can also direct the gas, muzzle flash, and/or noise generated by the action 104 of the firearm 102 through the other baffles 206 to reduce the noise, muzzle flash, and/or gasses escaping from the suppressor 100 at the exit portal 114. The blast baffle 202 can comprise a plurality of openings 208 to redirect and/or capture the gas, muzzle flash, debris, and/or noise between an outer portion 210 of the spacers 204 and within an inner surface 212 of the tube 110.

A plurality of spacers 204 capture various baffles 206 and are interposed between, and couple, the blast baffle 202 to the exit-side endcap 118. Each spacer 204 can house (e.g., encircle) one baffle 206. In some aspects, the spacer 204 can house and encircle more than one baffle 206. As described in greater detail below, the spacer 204 can orient the baffle 206 in an axial direction relative to axis 214 of the barrel 106 and also orient the baffle 206 in a transverse direction 216 that is orthogonal to axis 214. In this way, the spacer 204 can customize the form and structure of a pattern of baffles 206 that minimizes the muzzle flash, noise, and/or debris emitted from the suppressor 100 when firearm 102 is discharged. For example, the baffles 206 can be evenly spaced along axis 214 and/or between spacers 204.

Figure 3:
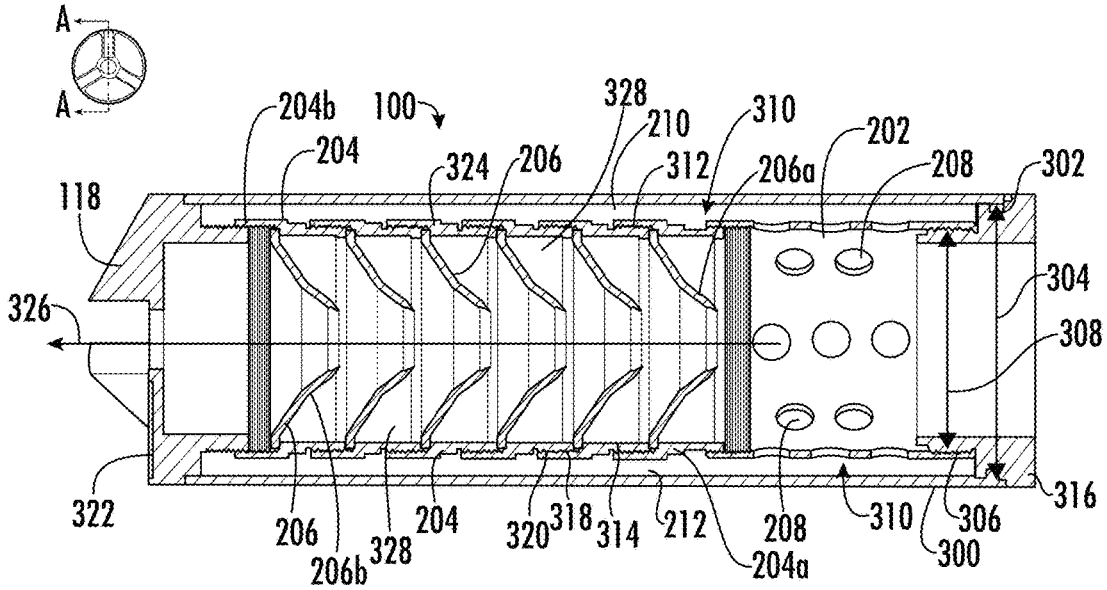
FIG. 3 is a cross-sectional view along lines A-A of the suppressor of FIG. 1.

FIG. 3 is a cross-sectional view along line A-A of the suppressor 100. The cross-sectional view demonstrates features of the suppressor 100 not visible from the exterior. For example, the barrel-side endcap 116 can include an outer sleeve 300 comprising a first set of threads 302 at a first outer diameter 304, and the blast baffle 202 can comprise a second set of threads 306 at a second outer diameter 308. The first set of threads 302 can be configured to engage the inner threads of tube 110, and the second set of threads 306 can be configured to engage the inner threads of the blast baffle 202. In this configuration, the first outer diameter 304 is greater than the second outer diameter 308 to receive the barrel 106 of the firearm 102. In other aspects, the first outer diameter 304 can be less than the second outer diameter 308.

In some aspects, a volume or cavity can be formed between the inner surface 212 of tube 110, and the outer portion 210 of the spacers 204 can provide an expansion chamber 310. The expansion chamber 310 can provide a cavity or volume inside tube 110 of the suppressor 100 to permit exhaust gases to expand and/or collect non-combusted debris, which helps to reduce the noise and/or reduce the muzzle flash when the firearm 102 is discharged.

The spacers 204 can have external threads 312 on a smaller first end 314, oriented on a barrel-side 316 of the spacer 204, and internal threads 318 on a larger second end 320, oriented on an exit-side 322 of the spacer 204. The baffle 206 can be captured in a lip 324 created between the adjacent internal threads 318 and external threads 312 of the adjoining spacers 204 to capture the baffle between two adjacent spacers 204.

The first spacer 204*a* can be coupled to the blast baffle 202 and an adjacent spacer 204 and captures a baffle 206*a* interposed between the adjacent spacer 204. The last spacer 204*b* can be coupled to the exit-side endcap 118 and an adjacent spacer 204. The last spacer 204*b* can capture a baffle 206*b* between the last spacer 204*b* and the exit-side endcap 118. Each spacer 204 can capture and support a baffle 206. With the exceptions of the first and last spacers 204*a,b* described above, a baffle 206 can be interposed and captured between two adjacent spacers 204.

In various aspects, the number of spacers 204 and/or baffles 206 is variable. For example, the number of spacers 204 and baffles 206 can be increased by an operator to create a longer suppressor 100, which can enhance the ability to silence noise and/or suppress muzzle flash. Alternatively, the number of spacers 204 and baffles can be decreased to create a shorter suppressor 100, which can reduce the weight of the suppressor 100, for example, for use on a handgun or pistol.

Figure 4:
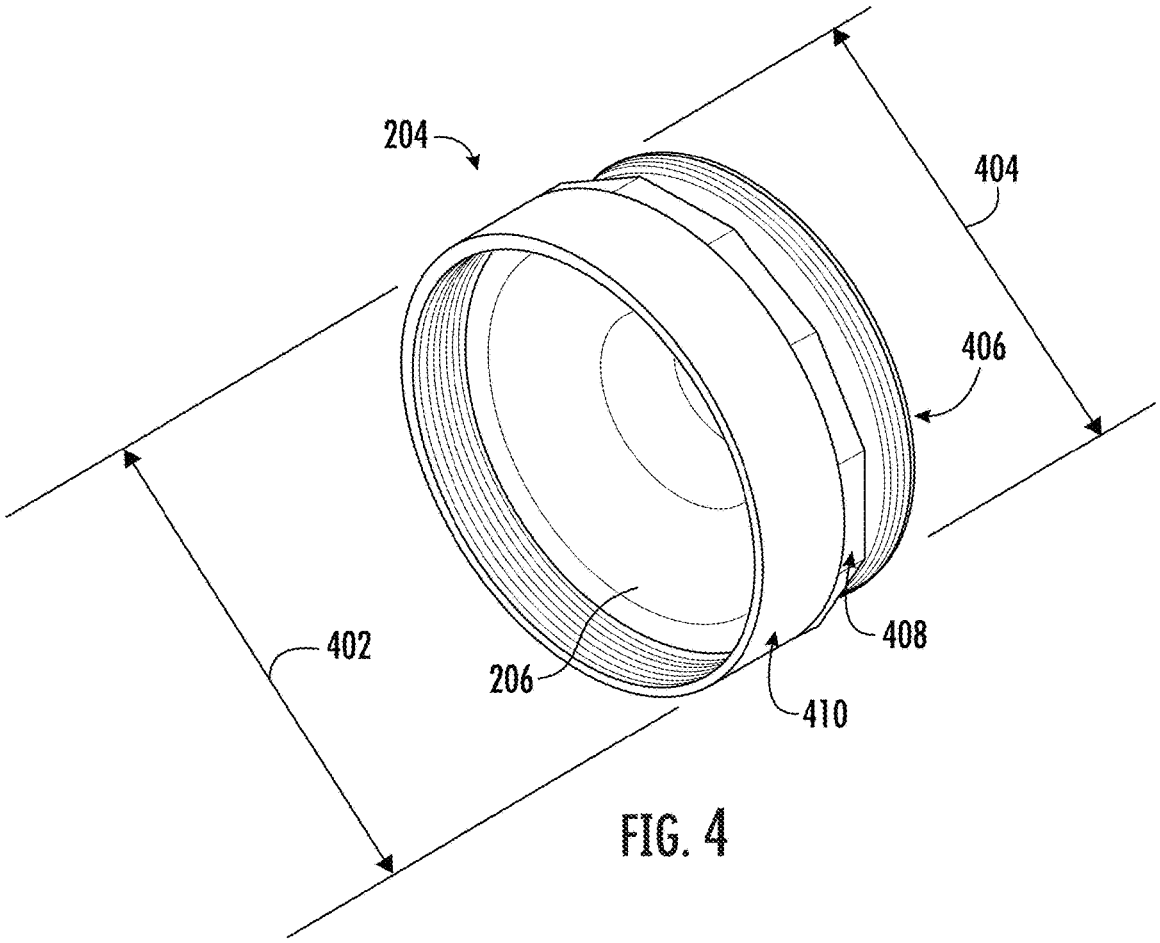
FIG. 4 is a perspective view of a baffle and a spacer in the suppressor of FIG. 3.
Figure 5:
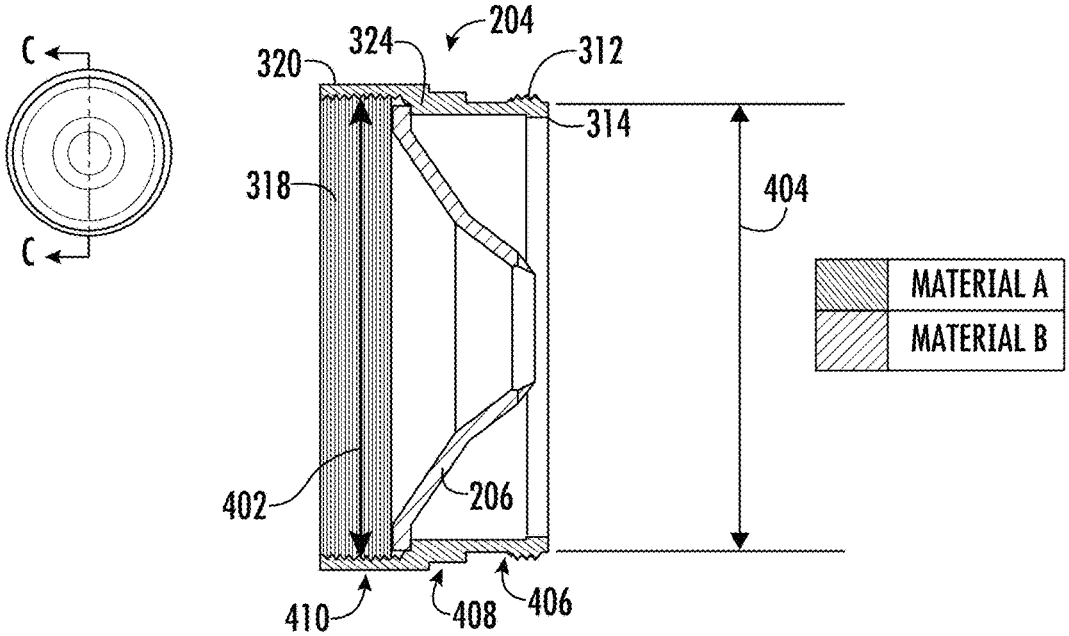
FIG. 5 is a cross-sectional view along lines C-C of the baffle and the spacer of FIG. 4.

FIG. 4 is a perspective view of the baffle 206 within the spacer 204 and configured to fit within suppressor 100 of firearm 102 (FIG. 1). FIG. 5 is a cross-section of baffle 206 within the spacer 204 of FIG. 4. The baffle 206 and spacer 204 function together to reduce the noise and/or muzzle flash produced and/or ejected by the firearm 102. The baffle 206 can be a cylindrical cone-shaped material (e.g., metal or composite). A plurality of baffles 206 within the suppressor 100 can form a series or structure of cone-shaped discs spaced to facilitate the separation of gasses. Similarly, the spacer 204 can separate and retain the baffle 206 to change and/or modify the natural frequency or resonant frequency of the firearm 102 and/or silencer or suppressor 100. In this way, the change (e.g., a decreased frequency response) of the system's resonant frequency can reduce the sound and/or debris emitted from the system.

The spacer 204 can comprise internal threads 318 on an inner diameter 402 of the spacer 204 configured to engage the external threads 312 on an outer diameter 404 of an adjacent spacer 204. The inner diameter 402 can be approximately equal to the outer diameter 404. The spacer 204 can be broken into three different segments, an attachment segment 406, a gripping segment 408, and an elongating segment 410. The outer diameter 404 of the attachment segment 406 can be approximately equal to the inner diameter 402 of the elongating segment 410 to facilitate the stacking up of a plurality of spacers 204, as described above. However, the outer diameter of the spacer can be different for each segment. The attachment segment 406 can define a smaller outer diameter than the gripping segment 408 and the elongating segment 410. Similarly, the outer diameter of the gripping segment 408 can be less than the elongating segment 410 and can be non-circular.

For example, the gripping segment 408 in the present aspect can be a dodecagon (e.g., a 12-sided shape). Other polygon shapes are considered. For example, the gripping segment 408 can comprise anywhere between 4 and 20 sides, specifically, between 8 and 16 sides, and more specifically, between 10 and 14 sides. The gripping segment 408 can comprise a non-circular or polygon exterior shape to facilitate gripping and tightening the spacer 204 onto an adjacent spacer 204 and/or onto the blast baffle 202, the barrel-side endcap 116, and/or the exit-side endcap 118, such as with a tool such as a wrench.

In FIGS. 3 to 5, a series or plurality of adjacent adjoining spacers 204 can capture a plurality of baffles 206. Each baffle 206 can be captured in the lip 324 created at the end of the internal threading of the spacer 204. Lip 324 can retain the baffle 206 and prevent axial movement of the baffle 206, e.g., towards the barrel-side endcap 116 and/or the exit-side endcap 118 (FIG. 1).

The elongating segment 410 provides the lip 324 to capture the baffle 206 and functions to extend the spacer 204 onto the next adjoining component of the suppressor 100. The lip 324 can be formed near the gripping segment 408, where the outer diameter of the spacer 204 begins its first reduction. In this way, the attachment segment 406 and/or the gripping segment 408 of the spacer 204 can axially restrain the baffle 206 from traveling along the bore axis 214 but may allow a rotational degree of freedom for the baffle 206. The spacer 204 functions to separate the baffles 206 and can prevent damage and/or misalignment of the various baffles 206 in the suppressor 100.

Baffles 206 facilitate the reduction of noise and muzzle flash produced by firearm 102. Baffles can be designed to trap and redirect the gases and debris that are produced when firearm 102 is fired. The baffle 206 is a cone-shaped disc that can be placed and oriented within the spacer 204. A plurality of spacers 204 can be joined to form a tube-like structure with a lip 324 in each spacer 204 that separates and axially supports each baffle 206. The tube-like structure formed by a series of baffles 206 and spacers 204 provides a pathway 326 for the projectile to travel, creating separation pockets 328 to capture gasses and debris. The separation pockets 328 can also modify the natural frequency of the firearm 102 and/or suppressor 100 to reduce the overall noise emitted by firing the projectile.

The spacer 204 can serve to separate and/or restrain the baffles 206. Together, the spacers 204 and the baffles 206 can provide a channel or pathway 326 for the projectile while also separating the gas and debris in separation pockets 328. In some aspects, the spacer 204 can further comprise an elongated slot or breather openings to permit captured gas and debris to flow through the spacer 204 and into the expansion chamber 310.

The baffles 206 create a series of chambers or separation pockets 328 that facilitate slowing down and redirecting the gas and other debris from pathway 326 of the projectile. The baffles 206 can be configured to fit snugly inside the lip 324 of the spacer 204 and oriented to maximize the gas and debris that is separated from the pathway of the projectile. The baffles 206 create a tight seal about pathway 326 that enhances the gas, debris, and noise reduction of the suppressor 100. In some aspects, the baffles 206 can be spaced apart to facilitate airflow and cooling of the captured gas. This configuration facilitates customization by the operator and permits the use of a more specific design and/or configuration of the baffles 206 and spacers 204 for various firearms, the desired weight of the suppressor 100, the desired noise reduction, and the preferences of the user.

FIG. 5 shows the different materials that can be used to construct the endcaps (116 and/or 118) blast baffle 202, spacer 204 and/or baffle 206, and/or other components of the suppressor 100 For example, the spacer 204 can be constructed from high-strength high-temp, alloys and can include low-weight materials, such as stainless alloys, including stainless steel, aluminum alloys, and/or tungsten alloys. Specific aspects comprise stainless steel alloys or nickel alloys like Stellite™, Inconel®, Hastelloy®, and/or Waspaloy®. In addition, other materials can be used, such as carbon fiber reinforced plastic (CFRP) or another composite material.

Similarly, the baffle 206 can be constructed of durable low-weight material. For example, the baffle 206 can have a material density that is lower than the material density of the spacer 204 to provide a tough material in the baffles 206 that are resistant to high pressures and temperatures and provide a low-weight material density for materials in the spacer 204. The baffle 206 can comprise a different material than the spacer 204 and/or include alloys or composites. For example, the baffle 206 can comprise aluminum alloys, and/or titanium alloys. In addition, other low weight materials (e.g., with relative low material density) can be used, such as carbon fiber reinforced plastic (CFRP) or another composite material that provides sufficient structural reinforcement with a low material density.

Baffles 206 can comprise a stainless and/or high-temp alloy listed above, and may be combined with spacers 204 that comprise a low-weight titanium alloy (or other alloy listed above). This configuration of high-temp alloy baffles 205 and low-weight spacers 204 can enable the custom design and manufacture of an enhanced reduced-weight suppressor 100 that is easier to maneuver, install, and carry.

Construction of spacer 204 and/or baffle 206 can include 3D printing, machining, casting, injection molding, forging, die-forging, and/or die-casting. Manufacturing spacer 204 independent from baffle 206 enables using different high-strength, low-weight materials for spacer 204 and baffle 206. Moreover, the independence of the spacer 204 and baffle 206 facilitates orienting the baffle 206 in any desirable orientation about axis 214, regardless of the outer orientation of the spacer 204. That is, the spacer 204 may be oriented and/or fixed to an adjacent spacer 204, but the orientation of the baffle 206 can be indexed separately in any desired orientation independent of the orientation of the spacer 204. Once the orientation of spacer 204 is fixed by coupling it to an adjacent structure, baffle 206 retains a degree of freedom to rotate about axis 214 and can be indexed and/or locked in any position and/or orientation.

Figure 6:
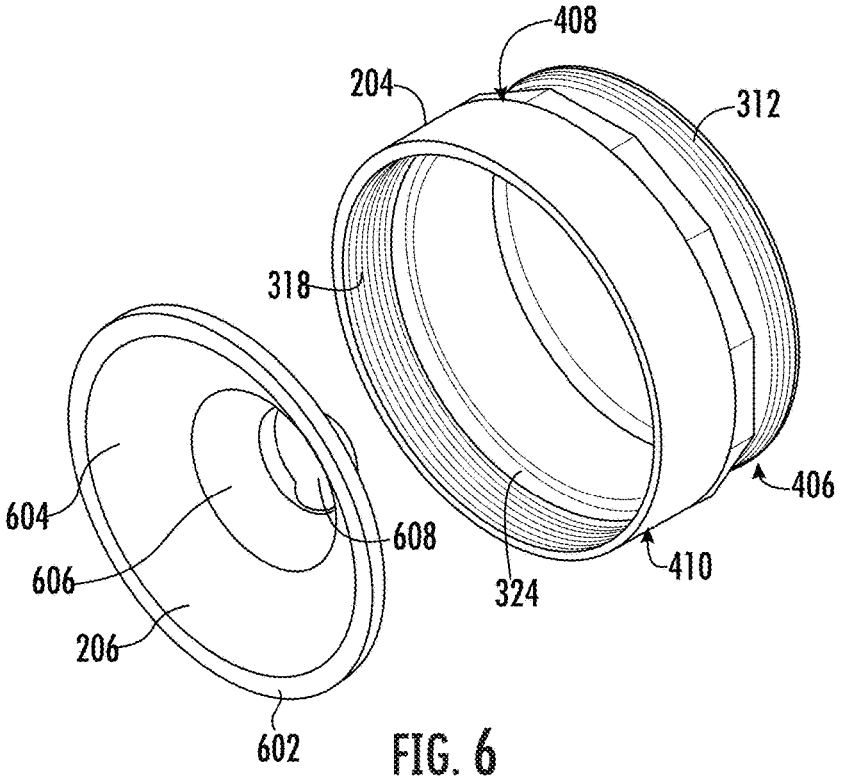
FIG. 6 is an exploded view of the baffle and the spacer of FIG. 4.

FIG. 6 is an exploded view of the baffle 206 and the spacer 204. This perspective shows how the baffle 206 is a series of concentric and narrowing cones. The baffle 206 comprises a circular base or flange 602, configured to align and fit within the lip 324 of the spacer 204 to retain the baffle 206 relative to the spacer 204. The flange 602 supports a first cone section 604, which narrows from the flange 602 to a second cone section 606. The second cone section narrows at an angle from the first cone section 604. The first cone section 604, and second cone section 606, form a different angle relative to axis 214. As illustrated, the second cone section 606 forms an angle that is more acute than the angle formed by the first cone section to facilitate the separation of the gas and debris from pathway 326 of the projectile and into the separation pockets 328 (FIG. 3).

The borehole 120 of the baffle 206 functions to separate the projectile from the hot gases and debris produced by firearm 102. For example, borehole 120 permits the projectile to pass through each baffle, and at each baffle 206 redirects more of the exploded gas and debris into the expansion chamber 310 (FIG. 3), where the gas can expand and cool down, effectively reducing the noise and/or muzzle flash produced by the firearm 102. The borehole 120 in each baffle 206 within the spacer 204 is aligned with the subsequent borehole in each baffle 206. This configuration enhances the separation of the gas and debris while ensuring the projectile can pass through the suppressor 100 in a straight line. In some aspects, this configuration can reduce turbulence and/or increase efficiency.

The size and shape of the borehole 120 can comprise a circular hole with an additional elongated slot 608, which can be formed as a pair of opposing notches in the current aspect. The diameter of the circular hole within slot 608 can vary based on the caliber of the firearm 102. Placing the elongated slots, 608 can facilitate the separation of the gas and debris to facilitate customization to the desired level of noise reduction and/or muzzle flash.

Figure 7:
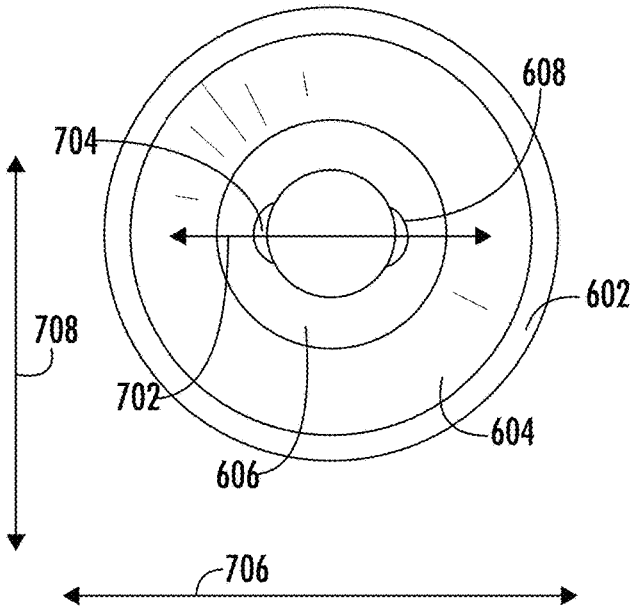
FIG. 7 is a top view of the baffle of FIG. 4 oriented in a longitudinal direction relative to the bore axis.
Figure 8:
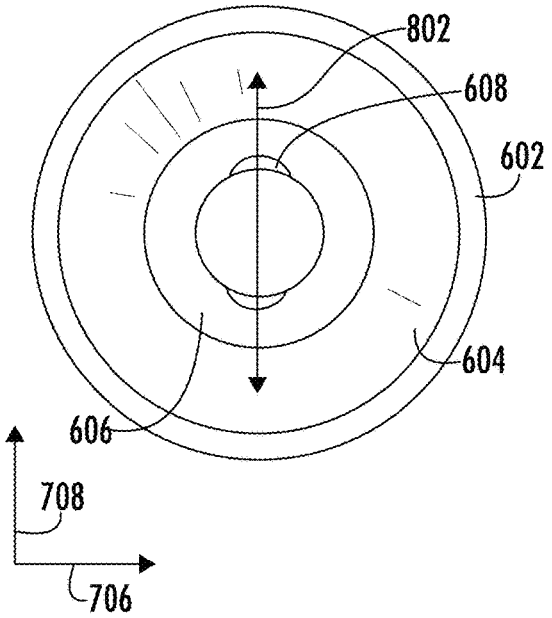
FIG. 8 is a top view of the baffle of FIG. 4 oriented in a transverse direction relative to the bore axis.

FIGS. 7 and 8 show the top views of baffle 206 oriented in a longitudinal direction 702 and a transverse direction 802, respectively. The bore axis 214 is centrally located in the middle of borehole 120. FIGS. 7 and 8 illustrate that baffle 206 has an elongated slot line 704 that defines an orientation for baffle 206 within spacer 204 (FIG. 6). The elongated slot line 704 is defined by a pair of opposed elongated slots 608 formed along the perimeter of borehole 120. For example, the baffle 206 can be rotated about its flange 602 to orient the elongated slot line 704 at a desired angle measured relative to the horizontal plane 706 of FIGS. 7 and 8. For example, in the longitudinal direction 702 shown in FIG. 7, the elongated slot line 704 can be aligned with, or approximately parallel to, the horizontal plane 706. In the transverse direction 216 shown in FIG. 8, the elongated slot line 704 can be approximately perpendicular to the horizontal plane 706, such that it aligns or is approximately parallel to the vertical plane 708 of FIGS. 7 and 8.

As will be readily understood, the flange 602 of the baffle 206 can be rotated in any orientation in the lip 324 of the spacer 204 (FIG. 6). Accordingly, the elongated slot line 704 for each baffle 206 can be manipulated or adjusted to be oriented at any desired angle relative to the horizontal plane 706. For example, the elongated slot line 704 can be orientated at an angle of 0, 5, 10, 15, 20, 25, 30, 35, 40, 45, 50, 55, 60, 65, 60, 65, 70, 75, 80, 85, 90, 95, 100, 105, 110, 115, 120, 125, 130, 135, 140, 145, 150, 155, 160, 165, 170, 175, or 180 degrees relative to the horizontal plane 706.

Since each baffle 206 is independently aligned, a series of baffles 206 can be constructed to maximize the removal of the gas and debris exiting from barrel 106 of the firearm (FIG. 1). For example, as shown in FIG. 7, the first baffle 206 can have elongated slot line 704 oriented at 0 degrees (e.g., equivalent to 180 degrees), and the second baffle 206 can have elongated slot line 704 oriented at 90 degrees, as shown in FIG. 8. Alternating baffles 206 at 90 degrees can reduce the amount of gas and/or debris that flows through the borehole of elongated slot 608 defining the pathway 326 through each baffle 206. In some aspects, the first baffle 206 can be oriented at 0 degrees, the second baffle 206 can be oriented at 30 degrees, the third baffle is oriented at 60 degrees, and the fourth baffle 206 can be oriented at 90 degrees. Similarly, the axis of rotation need not be the horizontal plane 706 but can be the vertical plane or any other plane.

The ability to orient each baffle 206 independently provides the operator flexibility and the ability to customize the baffle 206 and enhance the suppressor for their individual preferences. Similarly, offsetting the various baffles 206 can enhance the efficiency and/or reduce the weight to facilitate the suppressor 100 for use with smaller handheld firearms, such as pistols and revolvers.

Figure 9:
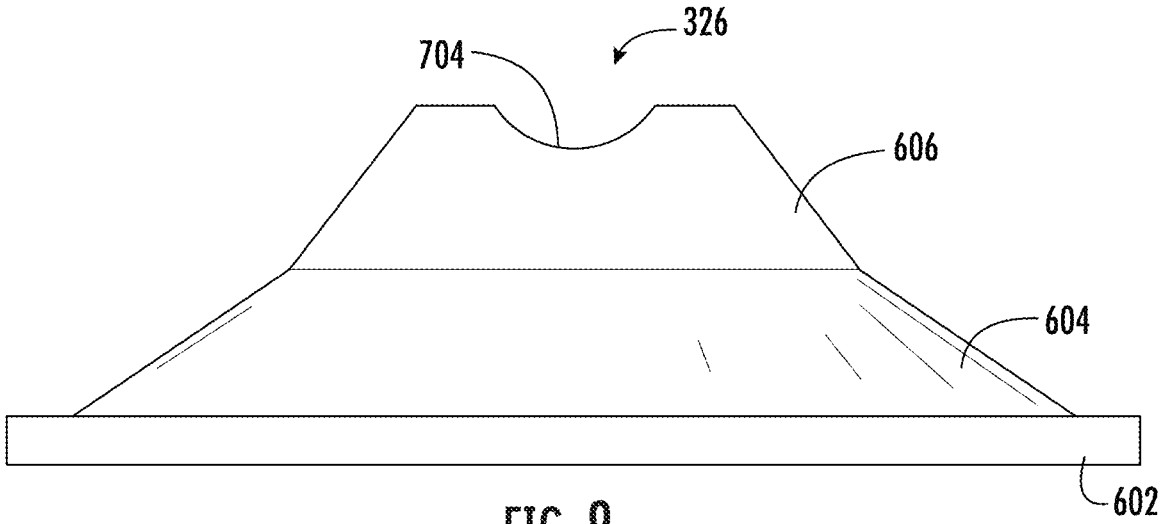
FIG. 9 is a side view of the baffle of FIG. 4, showing an elongated slot.

FIG. 9 is a side view of baffle 206 showing a side view of the elongated slot 608. The flange 602 supports the first cone section 604, and the second cone section 606 extends at a more obtuse angle from axis 214 to permit the gas closest to the projectile to pass through the elongated slots 608 into the next baffle 206. The elongated slot 608 can be formed by cutting a portion of the second cone section 606 of the baffle 206 lengthwise to form notches on opposite sides of the hole (e.g., borehole 120). This process creates the slot line 704 described above and facilitates orienting the baffle 206 relative to the spacer 204.

Figure 10:
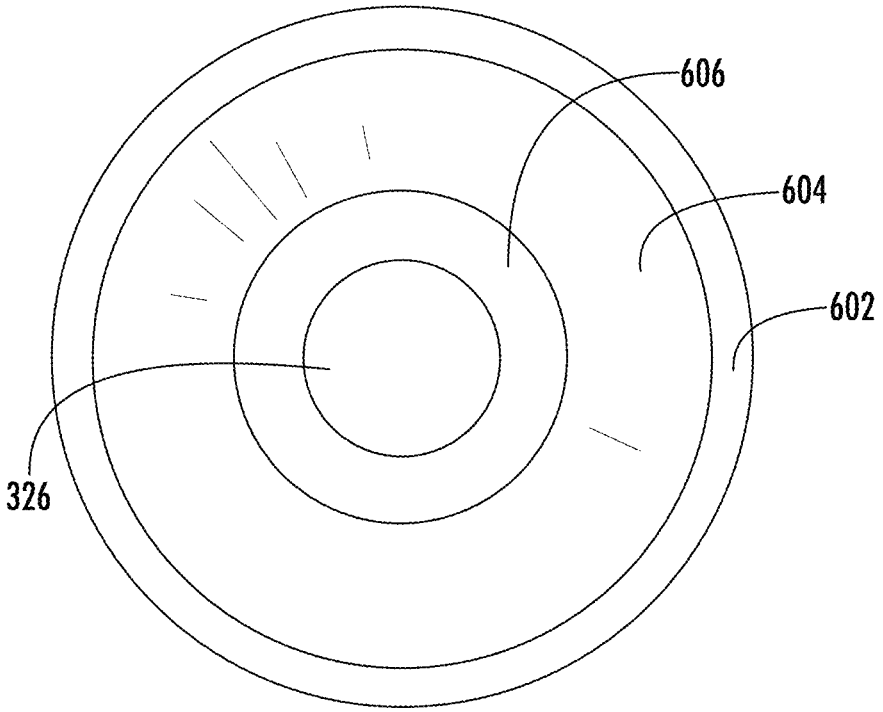
FIG. 10 is a bottom view of the baffle of FIG. 4.

FIG. 10 is a bottom view of baffle 206. The flange 602 supports the first cone section 604, which supports the second cone section 606. As shown from this view, the elongated slot line 704 is not visible. From the perspective of the exit-side 322 of the suppressor 100 looking toward barrel 106, the elongated slots 608 are not visible.

FIGS. 11-16 show various views of another aspect of suppressor 100. For example, the suppressor 100 shown in FIGS. 11-16 is the same as or similar to the suppressor in FIGS. 1-10, except the tube 110 attaches to an end of the spacers 204 and does not extend over the spacers 204. Thus, the outer portion 210 (FIG. 2) between the spacer 204 and tube 110 is eliminated, and an outer surface of spacers 204 in FIGS. 11-16 defines the outer surface of the suppressor 100.

Figure 11:
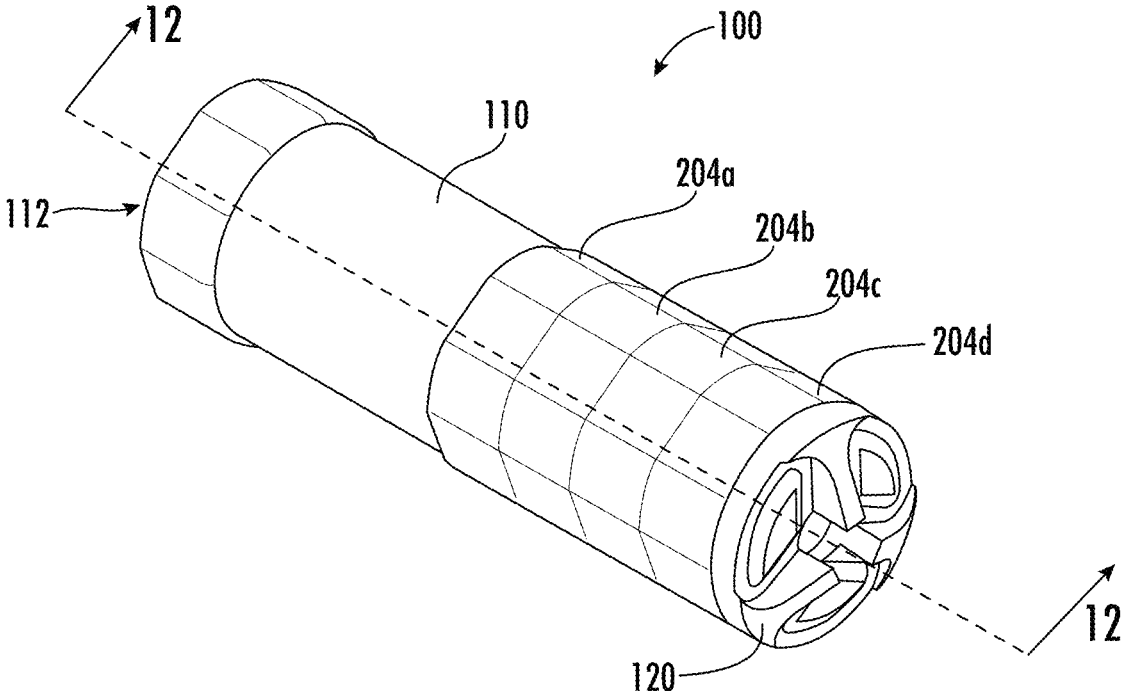
FIG. 11 is a perspective view of another suppressor, in accordance with another aspect of the current disclosure.
Figure 12:
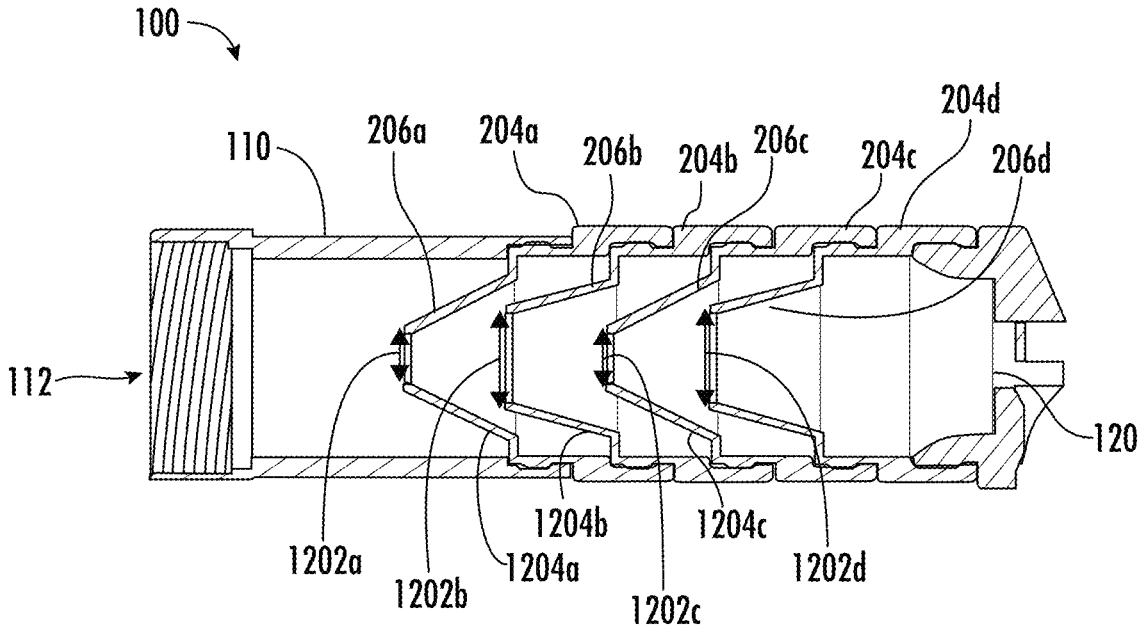
FIG. 12 is a cross-sectional view of the suppressor taken along line 12-12 of FIG. 11.

FIG. 11 shows four spacers 204*a-d*, where each spacer 204 comprises a respective baffle 206*a-d* (shown in FIG. 12). Mounting system 112 can be located on one end of suppressor 100 and can be configured to attach to barrel 106 of firearm 102 (FIG. 1). For example, the mounting system 112 couples the tube 110 attached to and/or supporting the spacers 204 and the baffles 206 to the firearm 102. The borehole 120 extends from the end of the suppressor 100 opposite the mounting system 112. As illustrated in FIG. 11, the spacers 204 can have an exterior surface with alternating surfaces (e.g., curvilinear and/or planar surfaces configured to receive a hand tool or crescent wrench) to facilitate the joining of one spacer (e.g., spacer 204*a*) to an adjacent spacer 204*b* and/or tube 110. Similarly, tube 110 can comprise an outer surface with various planar, curvilinear, or angular outer surfaces to facilitate clamping and rotating the tube 110 and/or coupled spacers 204 relative to the barrel 106 of the firearm 102.

Figure 14:
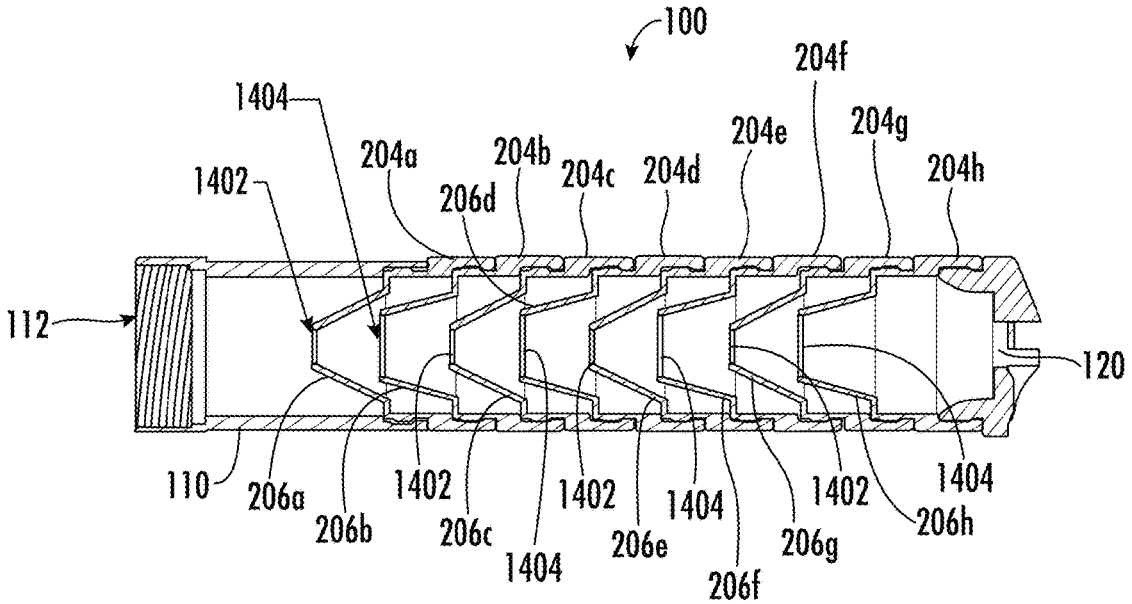
FIG. 14 is a cross-sectional view of an expanded suppressor comprising an alternating small hole, large hole spacer pattern.
Figure 15:
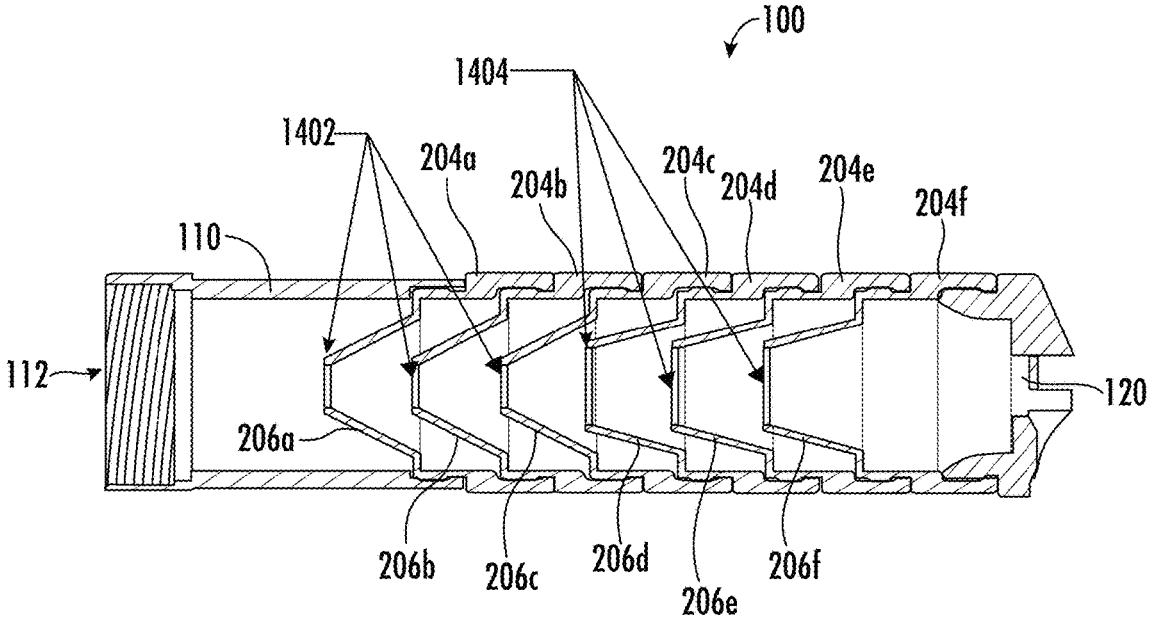
FIG. 15 is a cross-sectional view of a suppressor comprising a series of small hole spacers followed by a series of large hole spacers.
Figure 16:
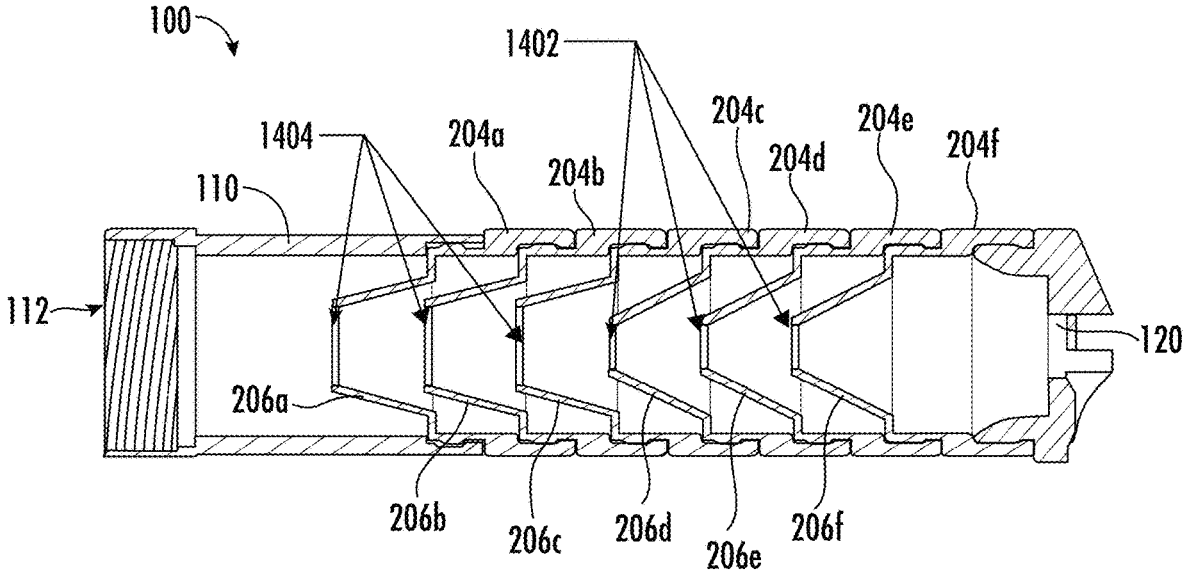
FIG. 16 is a cross-sectional view of a suppressor comprising a series of large hole spacers followed by a series of small hole spacers.

FIG. 12 is a cross-sectional view of the suppressor 100 taken along line 12-12 of FIG. 11. As described herein, suppressor 100 can comprise variable lengths and can have different sizes, numbers, and/or variations of spacers 204. For example, FIGS. 12-13 comprise four baffles 206*a-d* captured within the four spacers 204*a-d*, and FIGS. 14-16 show the elongated suppressor 100, comprising six baffles 206*a-f* captured within six spacers 204*a-f*. Other sizes and variations of spacers 204 and baffles 206 are envisioned. For example, the suppressor 100 can comprise any number of baffles 206 captured in various numbers (or sizes) of spacers 204, including two, three, four, five, six, seven, eight, nine, ten, or more spacers 204, and/or baffles 206. One feature of this disclosure is the ability of the operator to customize the length and/or sound muffling capacity of the suppressor 100 by altering the number, position, and/or orientation of the various spacers 204 and/or baffles 206 used to construct the suppressor 100. The end-user can thus obtain a customized and desirable outcome for the particular use and in-field requirements of the suppressor 100 attached to the firearm 102.

FIG. 12 shows alternating small and large holes or diameters for each baffle 206. For example, as shown in FIG. 12, baffles 206*a,c* comprise a small diameter 1202*a,c* and a narrow cone, defined by an acute angle 1204*a,c*. Baffles 206*b,d* comprise a large diameter 1202*b,d* and a broad cone, defined by a larger angle 1204*b,d*. That is, the diameter 1202*a,c* of the narrow cone baffles 206*a,c* is smaller than the diameter 1202*b,d* of the broader cone baffles 206*b,d*. Similarly, the angle 1204*a,c* of the narrow cone baffles 206 is smaller (e.g., fewer degrees or radians measured between the outer surface of the baffle 206 to the inner surface of the spacer 204) than the angle 1204*b,d* of the broader cone baffles 206.

The use of varying degrees and diameter sizes captures sound waves and/or debris within the suppressor 100 and enables an end-user to test, evaluate, and customize a particular configuration to customize the suppressor 100 for his/her particular needs. In addition, the alternating sizes can reduce the air friction and thus improve the ballistics of the bullet, without reducing the range of the bullet or the expected trajectory of the bullet. Thus, the operator can customize the muffling of the sound, quantity of debris, and/or length of the flash escaping from the borehole 120 of the suppressor 100 by adding (or taking away) various spacers 204 and/or baffles 206 having larger and/or smaller holes.

Figure 13:
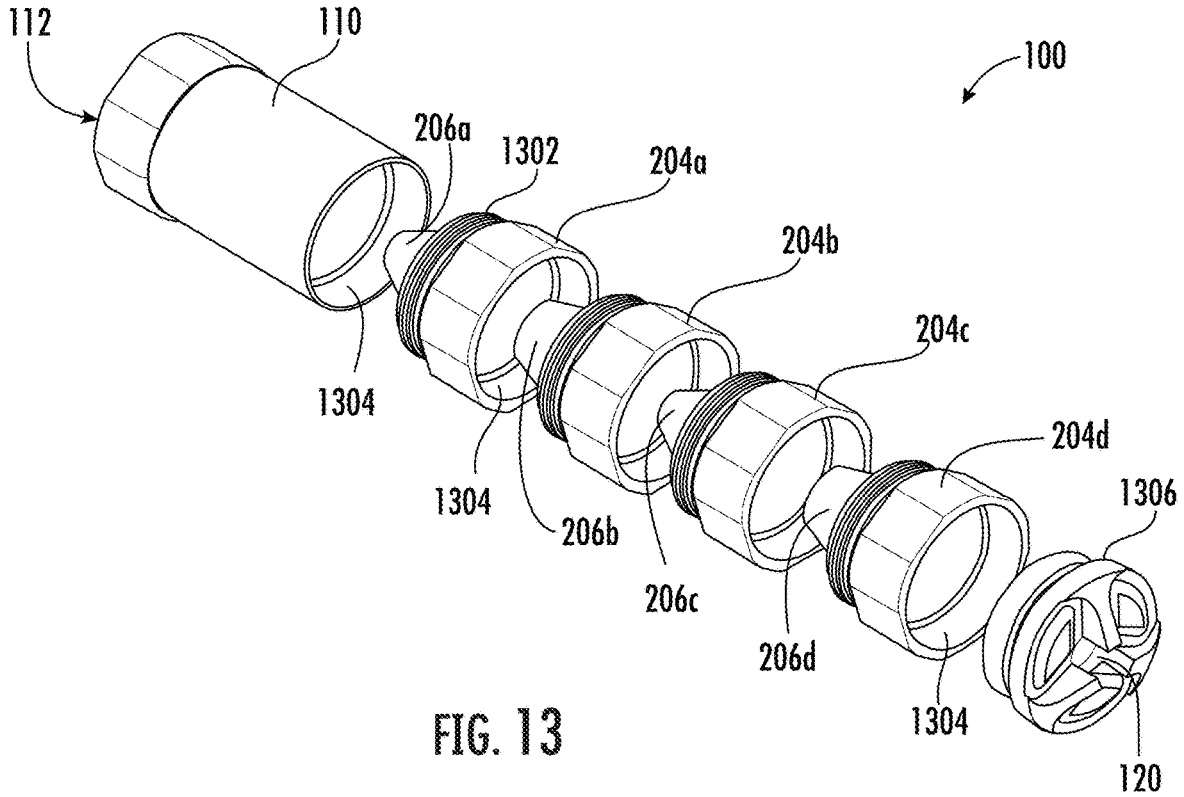
FIG. 13 is an exploded view of the suppressor of FIG. 11.

FIG. 13 is an exploded view of the shortened suppressor 100 shown in FIGS. 11-12, e.g., with four baffles 206*a-d* captured within four spacers 204*a-d*. Different baffles 206 can have different cone shapes and/or diameters. For example, as shown in FIG. 13, baffles 206*a* and 206*c* comprise a tighter cone shape and smaller diameter, as measured at the point of egress, than baffles 206*b* and 206*d*.

The alternating pattern of the smaller diameter baffle 206*a* adjacent to the larger diameter baffle 206*b* is repeated for the smaller diameter baffle 206*c* and the larger diameter baffle 206*d*.

Specifically, the baffles 206 are oriented such that they alternate between the small diameter and narrow cone baffle 206*a,c* immediately adjacent to (or attached to) a large diameter broad cone baffle 206*b,d*. Each spacer 204*a-d* can comprise an external thread 1302 on the exit side (e.g., the side closest to the exit borehole 120) and an internal thread 1304 on the barrel side (e.g., closest to the barrel 106). This alternating pattern can facilitate the joining, attaching, and/or coupling the external threads 1302 of the spacer 204 to the internal threads 1304 of an adjacent spacer 204 to construct the desired suppressor 100. Similarly, the external threads 1302 of the spacer 204 can couple to internal threads 1304 of the tube 110 to facilitate attaching the completed suppressor 100 to the barrel 106 of the firearm 102.

FIGS. 14-16 show various cross-sectional views of the expanded suppressor 100 comprising six baffles 206*a-f* captured within six spacers 204*a-f*, respectively. The figures show different orientations of the baffles 206 within the spacers 204 to obtain various desired effects. For example, FIG. 14 shows an alternating pattern of small holes 1402 and large holes 1404 to enhance the debris captured and the noise reduction of the suppressor 100 without compromising the ballistics of the bullet exiting the suppressor 100. The alternating small hole 1402 and large hole 1404 pattern of the baffles 206 and spacers 204 can enhance the noise reduction and debris collection of the suppressor 100.

FIGS. 15 and 16 show two similar but opposed cross-sectional views of the suppressor 100 comprising either a series of small hole 1402 baffles 206 followed by a series of large hole 1404 baffles 206 or a series of large hole 1404 followed by a series of small hole 1402 baffles 206. For example, FIG. 15 shows a series (e.g., a plurality of one or more, in this case three) small hole 1402 spacers 204 and/or baffles 206 followed by a series of large hole 1404 spacers 204 and/or baffles 206. FIG. 16 shows the same cross-sectional view of the suppressor 100 comprising a series of (a plurality, two, three, four, or more) large hole 1404 baffles 206 followed by a series of small hole 1402 baffles 206.

The orientation and position of small hole 1402 and large hole 1404 baffles 206 and/or spacers 204 can enhance the debris captured in the suppressor 100, reduce the muzzle flash from the firearm 102, enhance the noise suppression, and/or customize the suppressor 100 for a particular bullet or projectile. In this way, the suppressor 100 can be customized and enhanced based on in-field need and/or by the addition or removal of various components to or from the suppressor 100.

The description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an," and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B," as used herein, means "only A, only B, or both A and B"; while the phrase "one of A and B" means "A or B."

As used herein, unless the context clearly dictates otherwise, the term "monolithic" in the description of a component means that the component is formed as a singular component that constitutes a single material without joints or seams.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the seat nearest to and occupied by a user of a seat; "rear" is that end of the seat that is opposite or distal the front; "left" is that which is to the left of or facing left from a person sitting in the seat and facing towards the front; and "right" is that which is to the right of or facing right from that same person while sitting in the seat and facing towards the front. "Horizontal," "horizontal orientation," or "horizontal plane" describes that which is in a plane extending from left to right and aligned with the horizon, e.g., in the orientation illustrated in the figures. "Vertical," "vertical orientation," or "vertical plane" describes that which is in a plane that is angled at 90 degrees to the horizontal.

One should note that conditional language, such as, among others, "can," "could," "might," or "may," unless specifically stated otherwise or otherwise understood within the context as used, is generally intended to convey that certain aspects include, while other aspects do not include, certain features, elements and/or steps. Thus, such conditional language is not generally intended to imply that features, elements, and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An assembly comprising:

a spacer assembly comprising:

a spacer comprising a spacer material defining a spacer material density; and a baffle comprising a baffle material defining a baffle material density that is different from the spacer material density;

wherein:

the spacer comprises an elongated section comprising a lip, a gripping section coupled to the elongated section, and an attachment section; and the baffle comprises a base oriented within the lip, wherein the lip restrains the baffle in an axial direction, and the base is free to rotate within the lip.

2. The assembly of claim 1, wherein the gripping section abuts the elongated section to form and support the lip.

3. The assembly of claim 1, wherein the baffle comprises an elongated slot.

4. The assembly of claim 1, wherein the baffle is a first baffle comprising a first elongated slot and the spacer assembly further comprises a second baffle comprising a second elongated slot coupled to the first baffle, wherein the first elongated slot is oriented at a different angle from the second elongated slot.

5. The assembly of claim 1, wherein the baffle comprises a stainless steel or a nickel alloy.

6. The assembly of claim 1, wherein the spacer comprises a stainless steel or a nickel alloy.

7. The assembly of claim 1, wherein the baffle and the spacer are made of a die-forged material.

8. The assembly of claim 1, wherein the spacer is locked on an adjacent structure in a first orientation, and the baffle retains a degree of rotational freedom.

9. The assembly of claim 1, wherein the baffle comprises a first cone section and a second cone section, and wherein an angle formed between a barrel axis and the first cone section is different from an angle formed between the barrel axis and the second cone section.

10. An assembly comprising:

a spacer assembly comprising:

a spacer comprising a spacer material defining a spacer material density; and a baffle comprising a baffle material defining a baffle material density that is different from the spacer material density;

wherein the spacer is locked on an adjacent structure in a first orientation, and the baffle retains a degree of rotational freedom.

11. The assembly of claim 1, wherein:

the spacer comprises an elongated section comprising a lip, a gripping section coupled to the elongated section, and an attachment section; and the baffle comprises a base oriented within the lip, wherein the lip restrains the baffle in an axial direction, and the base is free to rotate within the lip.

12. The assembly of claim 1, wherein a gripping section abuts an elongated section to form and support a lip.

13. The assembly of claim 1, wherein the baffle comprises an elongated slot.

14. The assembly of claim 1, wherein the baffle is a first baffle comprising a first elongated slot and the spacer assembly further comprises a second baffle comprising a second elongated slot coupled to the first baffle, wherein the first elongated slot is oriented at a different angle from the second elongated slot.

15. The assembly of claim 1, wherein the baffle comprises a stainless steel or a nickel alloy.

16. The assembly of claim 1, wherein the spacer comprises a stainless steel or a nickel alloy.

17. The assembly of claim 1, wherein the baffle and the spacer are made of a die-forged material.

18. The assembly of claim 1, wherein the baffle comprises a first cone section and a second cone section, and wherein an angle formed between a barrel axis and the first cone section is different from an angle formed between the barrel axis and the second cone section.

* * * * *